United States Patent [19]

Ericson

[11] Patent Number: 4,777,676

[45] Date of Patent: Oct. 18, 1988

[54] SANITARY APPLIANCES WITH AN INDIRECT OUTLET AND HIDDEN DRAINAGE MECHANISM

[76] Inventor: Kurt S. B. Ericson, Prins Boudewijnlaan, 48 Schilde, Belgium/B-2230

[21] Appl. No.: 897,639

[22] PCT Filed: Nov. 22, 1985

[86] PCT No.: PCT/EP85/00634

§ 371 Date: Jul. 24, 1986

§ 102(e) Date: Jul. 24, 1986

[87] PCT Pub. No.: WO86/03240

PCT Pub. Date: Jun. 5, 1986

[30] Foreign Application Priority Data

Nov. 30, 1984 [SE] Sweden ..... 8406083

[51] Int. Cl.[4] ..... A47K 1/04

[52] U.S. Cl. ..... 4/619; 4/624; 4/651; 4/650; 4/286

[58] Field of Search ..... 4/286, 287, 290, 295, 4/624, 651, 619, 650, 198–199

[56] References Cited

FOREIGN PATENT DOCUMENTS 140899 11/1900 Austria .
191875 9/1905 Fed. Rep. of Germany .
1609108 2/1970 Fed. Rep. of Germany .

*Primary Examiner*—Henry K. Artis
*Attorney, Agent, or Firm*—Zarley, McKee, Thomte, Voorhees & Sease

[57] ABSTRACT

A sanitary appliance comprising a main basin (11) and an adjacent chamber (1) separated from said basin by a wall (3), said main basin being provided with an outlet (2) communicating with said chamber, said chamber being also provided with an outlet (5), the appliance further comprising an opening and closing device (7) mounted in the chamber and operated from outside the chamber, said device comprising an upstanding pipe movable between a closing position wherein it prevents liquid to flow from the outlet of the main basin directly to the outlet of the chamber, and an open position, wherein it permits such liquid flow; at least a part of the wall (3) separating the chamber and the main basin being removable.

7 Claims, 8 Drawing Sheets

SANITARY APPLIANCES WITH AN INDIRECT OUTLET AND HIDDEN DRAINAGE MECHANISM

SUMMARY OF THE INVENTION

A sanitary appliance comprising an easy accessible chamber, where is situated a mechanism combining the opening/closing of the outlet, the overflow, an air admittance system and a waterseal in an underlying container.

DESCRIPTION

The invention relates to a sanitary appliance such as a washbasin, a bidet, a bath or shower tub, a kitchen or laundry sink, a urinal, which appliance comprises a main basin and an adjacent chamber separated from said basin by a wall, said main basin being provided with an outlet positioned mainly in its side and communicating with said chamber, said chamber being also provided with an outlet, the appliance further comprising an opening and closing device mounted in the chamber and operated from outside the chamber, said device comprising an upstanding pipe movable between a closing position wherein it prevents liquid to flow from the outlet of the main basin directly to the outlet of the chamber and an open position wherein it permits such liquid flow.

Sanitary appliances of this type can be more attractive and give the designer more freedom in his design as the discharge hole in the bottom and especially the tightening plug for closing said hole are absent.

The quick clogging of such hole is at the same time avoided.

A sanitary appliance of this kind is known from British Pat. No. 363.601.

In a chamber having the form of a waste duct provided in a thickening portion of the rear wall of the main basin, a hollow rotatable sleeve valve is mounted.

In open position, said valve assures a direct communication between the outlet in the rear side of the main basin and the outlet in the bottom of the chamber.

By turning the sleeve valve, said communication is prevented.

German Pat. No. 140.899 also discloses a sanitary appliance of the above mentioned type.

The pipe of the opening and closing device is movable up and down.

In its downwards position, it closes the outlet in the bottom of the chamber.

Liquid can only be evacuated through openings in the upper end of the pipe, which openings act as overflow openings. In its upward position, liquid can be evacuated from the chamber through an opening in the lower end of the pipe. Because the chamber is hermetically closed to the exception of the outlets, the water evacuated through the last mentioned opening in the pipe sucks away the air in the chamber so that also a part of the water flows through the overflow openings at the upper end of the pipe.

The problem of both known appliances is the difficulty of cleaning the chamber.

Even if the opening and closing device could be removed from the appliance, the bottom of the chamber is not easily accessible.

If a water seal is directly mounted underneath the chamber, said water seal can pratically not be reached for cleaning through the chamber.

The water seal has to be unmounted from the outside of the appliance, what is not always possible or easy.

The invention has for object to remediate this drawback and to provide a sanitary appliance of the above mentioned type which permits an easy cleaning of the chamber wherein is mounted the opening and closing device and eventually also of a water seal forming container mounted underneath said chamber.

For this purpose, at least a part of the wall separating the chamber and the main basin is removable.

Said part of the wall can be totally removable, for instance by sliding or can be swung away with respect to the remainder of the wall.

In a particular embodiment of the invention, the appliance comprises a container underneath the chamber which communicates with the chamber through the outlet in the bottom of the chamber and the movable pipe of the opening and closing device extends through the outlet into said container and forms with said container a water-seal.

In this form of embodiment, the water-seal can be situated very high and easily hidden by the appliance itself or by for example a foot piece.

In the case of a bath tub, the bath tub can be installed very low above the floor.

This form of embodiment is especially useful in combination with the above mentioned characteristic as the water-seal can easily be reached for cleaning after removing the removable part of the wall separating the chamber and the main basin. Preferably said container is an integrated part of the appliance.

A sanitary appliance comprising a main basin, an adjacent chamber communicating with the main basin through an outlet and provided itself with an outlet which can be closed by means of an opening and closing device, and a container mounted underneath said chamber, forming an integrated part of the appliance and forming together with the lower part of the opening and closing device a water seal, is known as such from German patent application No. 1.609.108.

In this known appliance, however the opening and closing device does not comprise a movable pipe which can prevent or permit direct communication between the outlet of the basin and the outlet in the bottom of the chamber.

Said device comprises a tube which is fixedly mounted in the chamber and is provided with openings, which openings can be closed by means of a valve element movably mounted in the pipe.

This opening and closing device is therefore of a rather complicated structure.

In an advantageous form of embodiment of the invention, the sanitary appliance comprises an air-admittance device mounted in the chamber and connected to the container and allowing entry of air above the liquid into the container or in the waste outlet of the container, under conditions of reduced pressure.

In this form of embodiment, the drain system to which the appliance is connected can be smaller and has better hydraulic functions.

In a preferred embodiment of the invention, the movable pipe of the opening and closing device is provided at a position lying a distance above the bottom of the chamber when it is in closing position, with an overflow opening communicating through the chamber with the outlet of the basin.

The usual overflow opening in the side wall of the appliance can be omitted.

When the liquid level in the main basin rises above a determined value, the liquid which has the same level in the chamber, is evacuated through the overflow opening in the upper part of the movable pipe.

Other features and advantages of the invention will stand out from the following description of some forms of embodiment of a sanitary appliance according to the invention; this description is only given by way of example and does not limit the invention; the references numerals pertain to the accompanying drawings.

Figure 1:
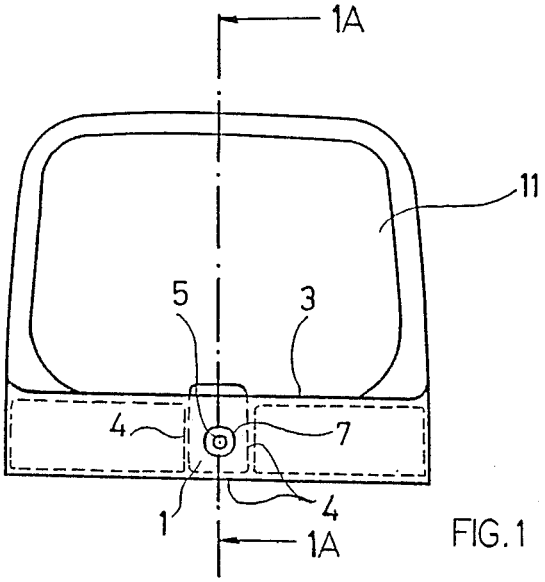
FIG. 1 shows the principle of the execution of a washbasin or bidet.
Figure 1A:
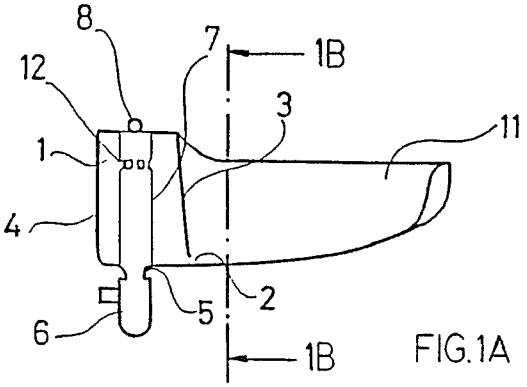
Figure 1B:
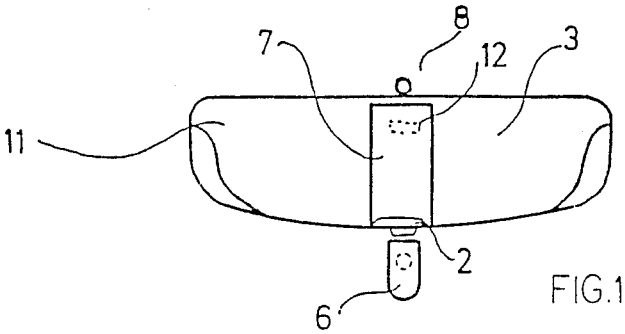
Figure 2:
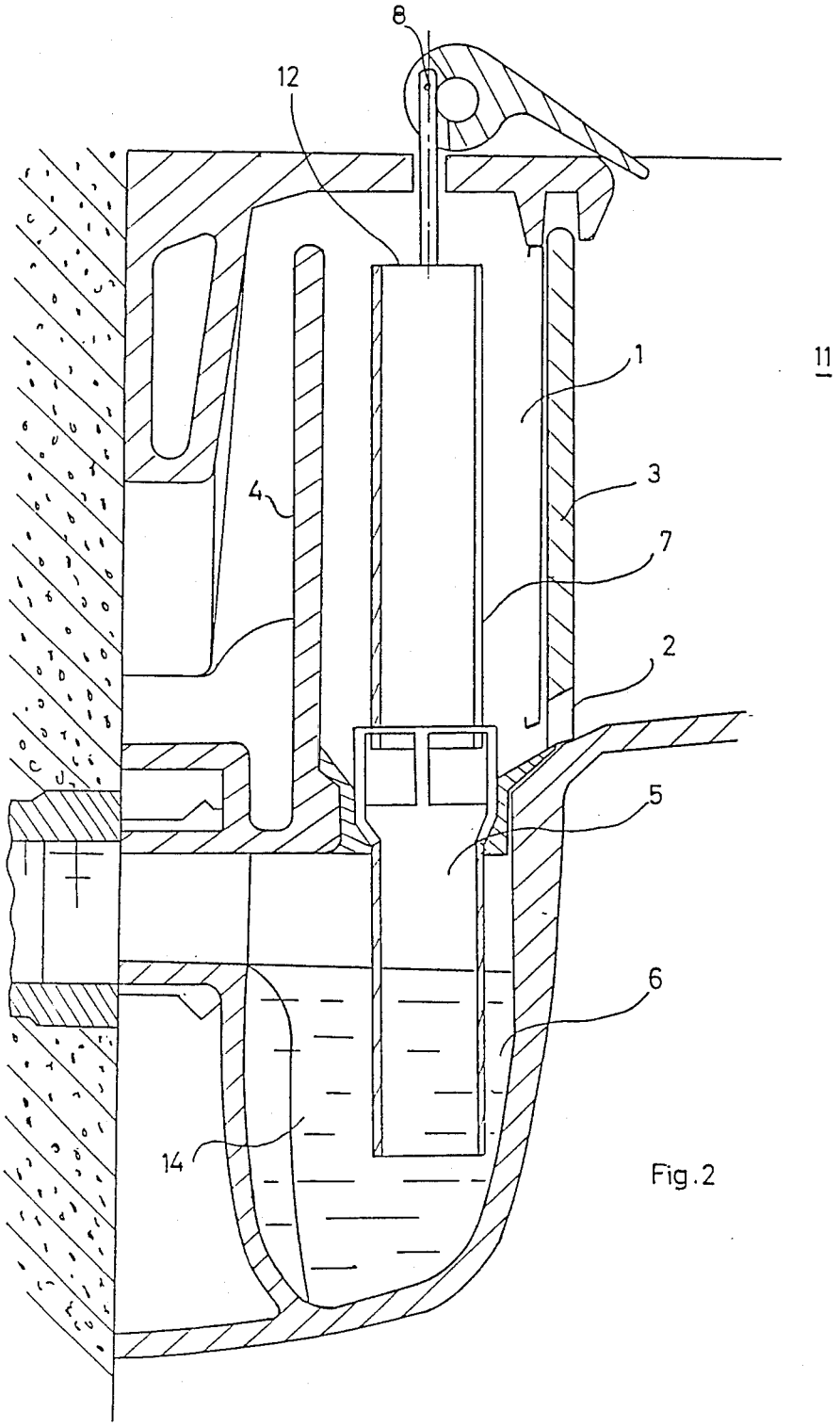
FIG. 2 illustrates an example of a chamber with a removable front in which the opening/closing pipe is in combination with a fixed pipe forming the waterseal in the underlying watertrap.

In a chamber (1), created by a removable front (3) with one or more holes (2) to the adjacent appliance (11), a wall with suitable form (4) and a bottom with hole (5), connected to a waterlock (6), is arranged a pipe (7) operable from outside the appliance (8), open in its upper and lower end, the lower end fitting and tightening in the outlet hole (5), the upper open end (12) designed for the overflow i.e. when the water rises in the appliance and consequently also in the chamber (1) up to the level with the open end (12), the water will run over automatically into the pipe (7) and further into the discharge system without doing harm. When the pipe (7) is lifted (changed) from its tightening position by the operating part (8), the water streams directly out through the hole (5) or openings (15) and into the waterlock (6).

Figure 3:
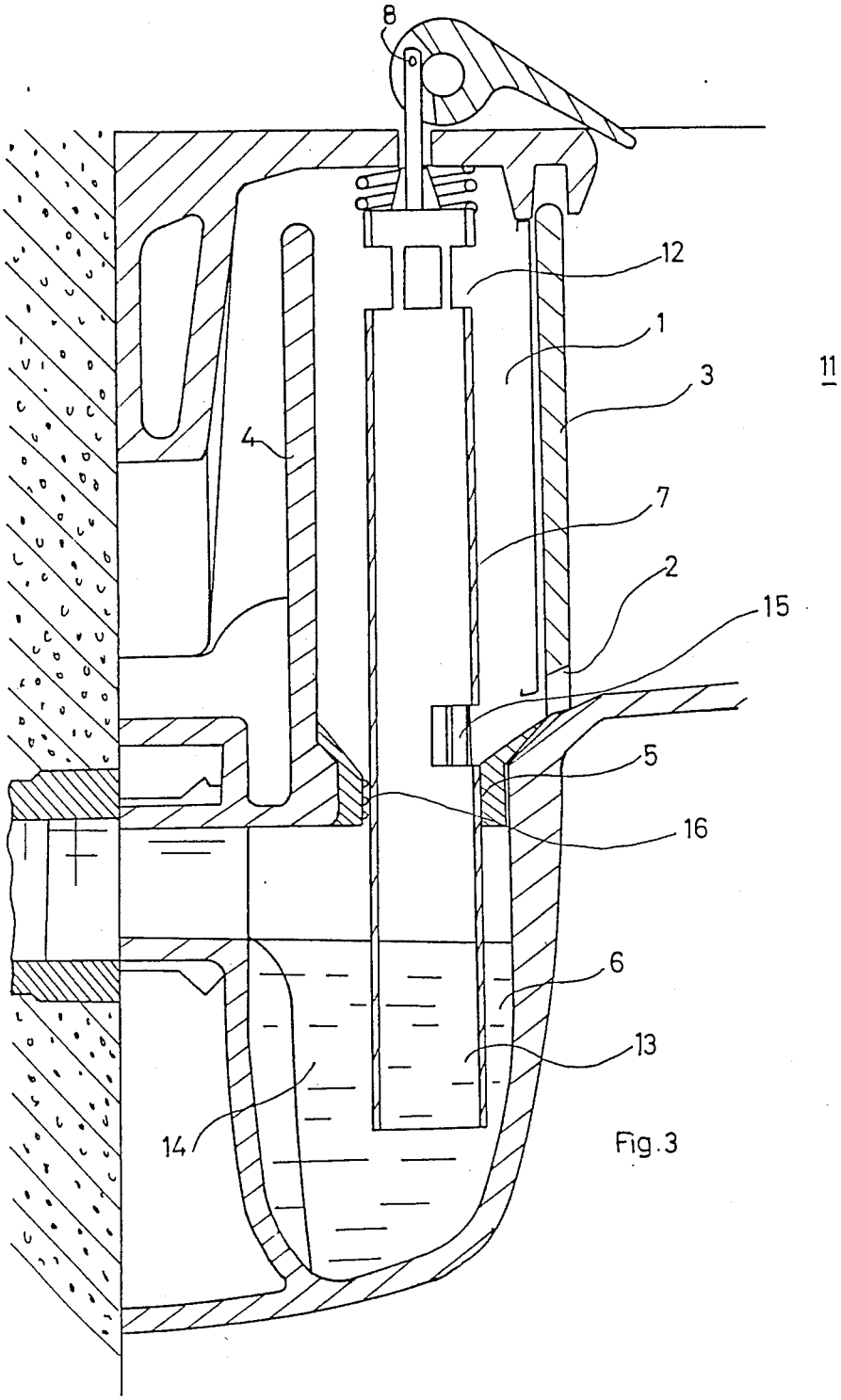
FIG. 3 illustrates the same as FIG. 2 but the opening/closing pipe is extended downwards and as such forms the seal in the trap.
Figure 4B:
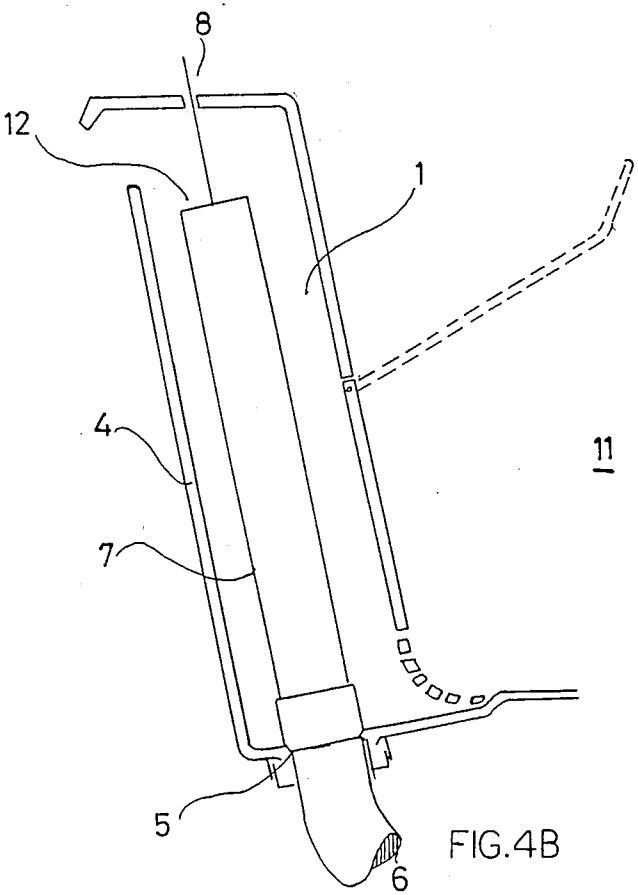
FIG. 4 shows the invention applied to a bathtub.
Figure 4A:
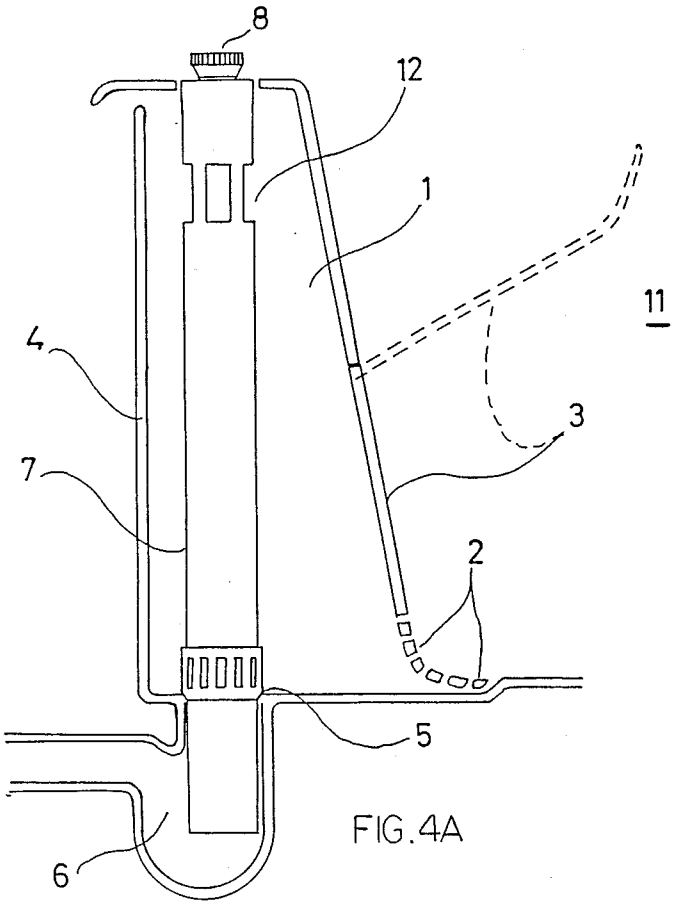

Further advantages can be obtained, as shown in FIG. 3., providing the pipe is lengthened so far down as to form the waterlock (13) in the container (14).

In closed position the apertures (15) are sunk in the seat (16) and they are disengaged when the pipe (7,13) is lifted. Owing to this the container (14) can either be made as an integrated part of the appliance or manufactured in a very simple way and moreover the bowl and outlet can be easily reached for inspection and maintenance by taking away the mechanism (7,13) after removing the front (3).

Figure 5:
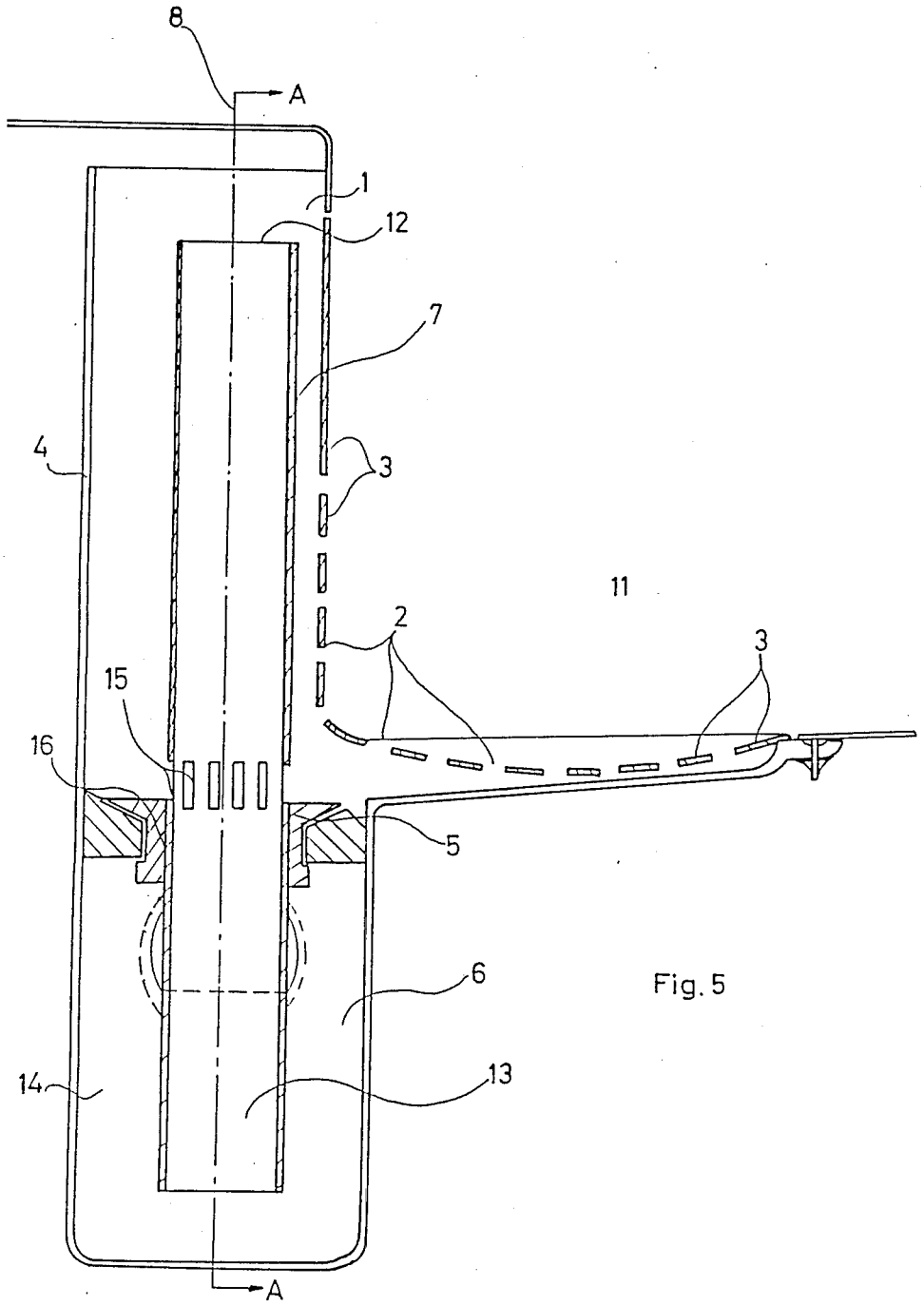
FIG. 5 illustrates the invention applied to a sink.
Figure 6:
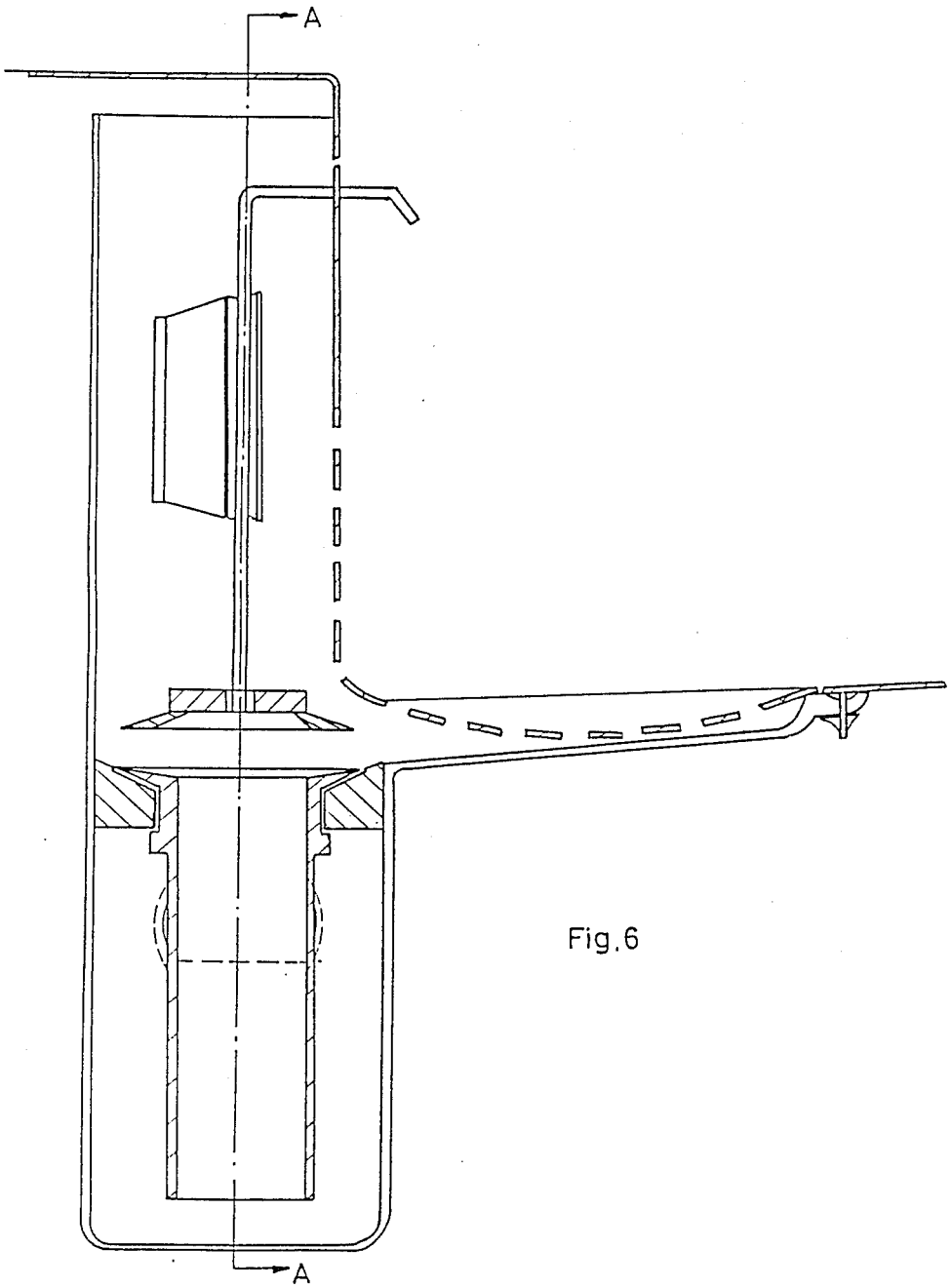
FIG. 6 is the same as 5 but without overflow.

FIGS. 5 and 6 show how the invention can be adapted to a sink, where the water can flow out even if the lower part of the basin would be clogged by foodrests. The removable front has in this case the form of a scoop and covers part of the bottom. In this way peels, foodrests etc. can be easily disposed of.

In conventional installations it is of vital importance that the pipes behind the sanitary appliance have sufficient diameter in order to secure the good function of the watertrap, which prevents the foul air in the discharge system to penetrate into the living area of a house. If the pipes have a too small diameter, the outflowing water will fill the whole section of the pipe and so cause a pump effect which will influence the trap when the water stops flowing.

Figure 7:
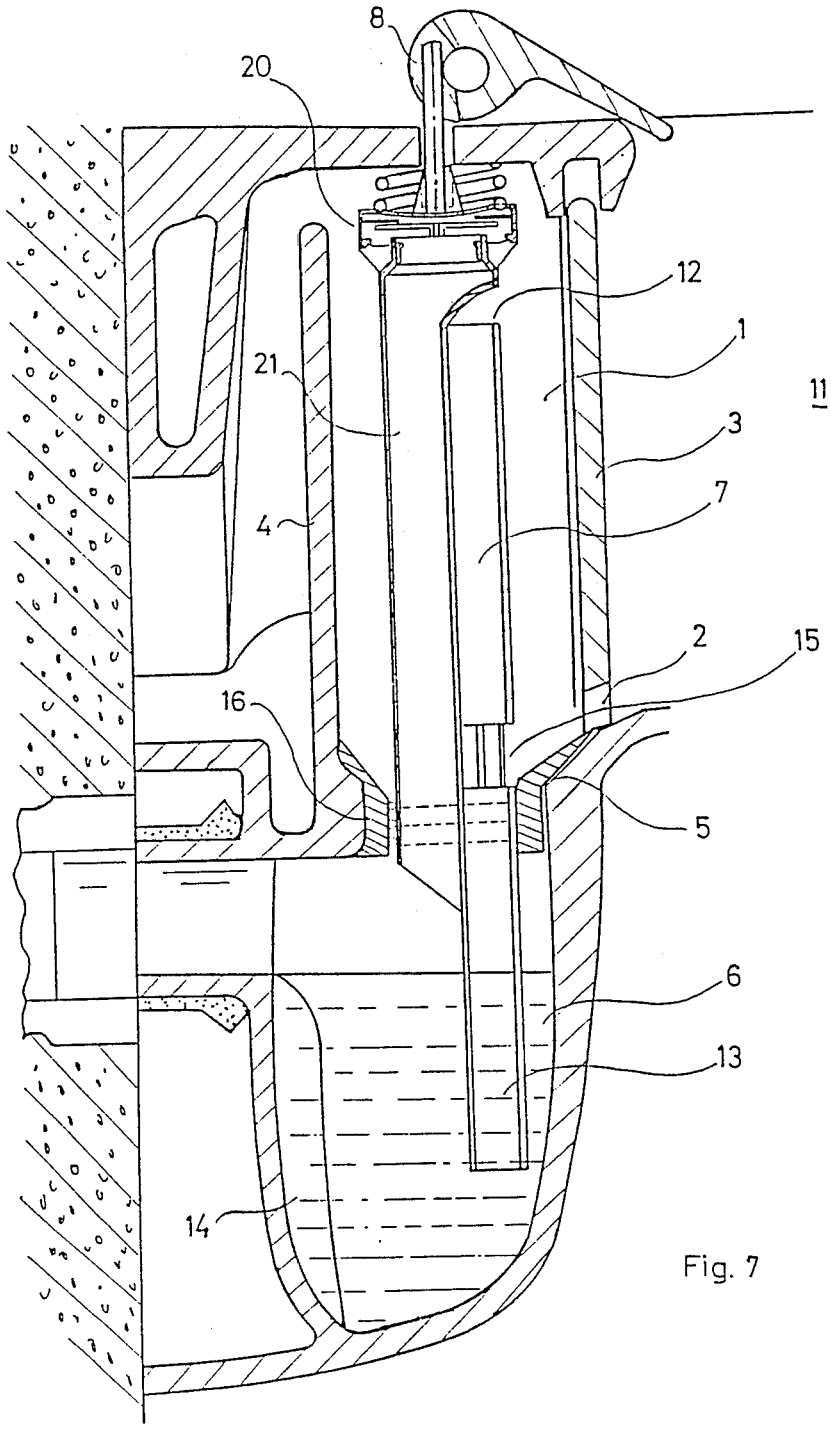
FIG. 7 illustrates an air admittance valve incorporated in the movable opening/closing pipe.
Figure 8C:
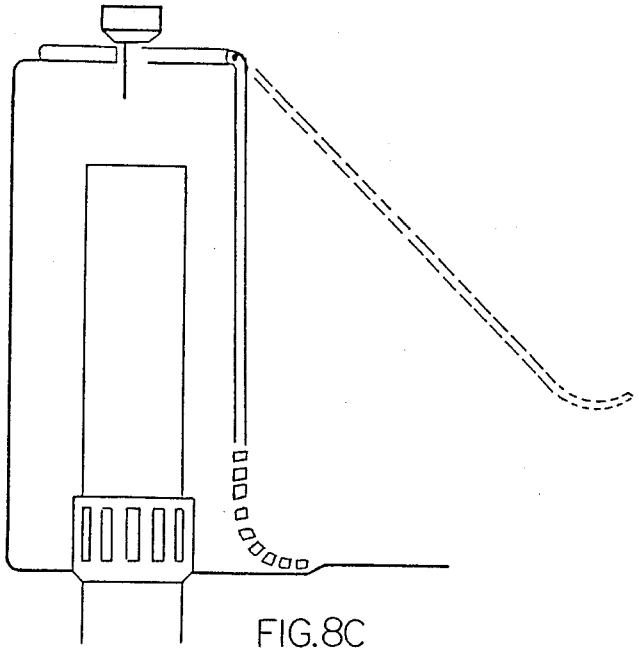
FIG. 8 shows an alternative for the opening/closing mechanism.
Figure 8B:
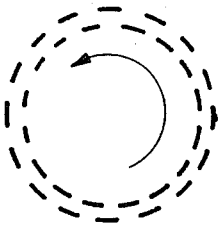
Figure 8A:
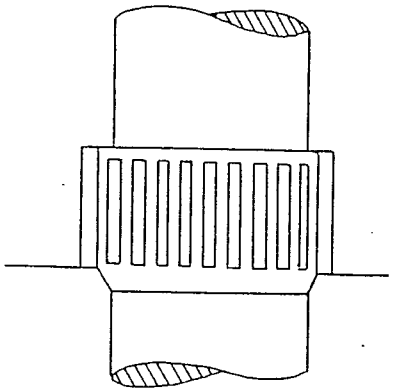

In order to break this pump effect an air admittance valve described e.g. in Pat. No. GB 2.014.697 (FIG. 7, no. 20) can be placed in chamber (1) above the flood level, connected by a separate channel (21) with the top of container (14) by-passing the opening/closing mechanism and the waterseal. Said channel (21) can as well be independant as integrated part of the movable pipe (7). In this way air is admitted into the system when underpressure or pump effects occur and so equilibrate the pressure preventing the waterlock to be influenced.

Consequently the diameter of the discharge system can be diminished since the pipes can be completely filled up and therefore the speed of the outflowing water be increased, what gives furthermore as an advantage that sedimentation and clogging of the system is prevented.

The invention is not limited to the sanitary field but can also find other application areas for other types of tanks and containers within industrial kitchens, industries etc.

It is evident that the application of the invention on new constructions of sanitary appliances, not only aims at rendering them more attractive by taking away the customary ugly outlet and overflow holes but also at impoving their function, at simplifying the actual expensive and complicated opening/closing device and overflow and at reducing considerably the number of screws and fittings, simplifying thus the installation, which becomes more economic. Finally, the invention contributes to the fact that cupboards, where e.g. washbasins and sinks are built in, can be fully used, since the customary voluminous watertraps become on the one hand smaller and on the other hand will be situated at the backside of the appliance.

I claim:

1. A sanitary appliance comprising:

a main basin;

a chamber having an outlet;

a wall separating the main basin and the chamber;

the main basin having an outlet communicating with the chamber;

an opening and closing device mounted in the chamber and operable from outside the chamber, the device including an upstanding pipe movable between a closed position which prevents liquid from flowing directly from the main basin outlet to the chamber outlet and an open position which allows such liquid flow; and at least a part of the wall being removable to allow access to the chamber for cleaning.

2. A sanitary appliance according to claim 1, characterized in that it comprises a container (14) underneath the chamber which communicates with the chamber through the outlet in the bottom of the chamber, and in that the movable pipe of the opening and closing device extends through the outlet into said container and forms with said container a water-seal (13).

3. A sanitary appliance according to claim 2, characterized in that said container (14) is an integrated part of said appliance.

4. A sanitary appliance according to claim 2, characterized in that it comprises an air-admittance device (20) mounted in the chamber and connected to the container and allowing entry of air above the liquid into the container (14) or in the waste outlet of the container under conditions of required pressure.

5. A sanitary appliance according to claim 4, characterized in that the air-admittance by-passes the opening and closing device and the water-seal formed by the pipe of said device and the water in the container.

6. A sanitary appliance according to claim 1, characterized in that the movable pipe of the opening and closing device is provided at a distance above the bottom of the chamber when it is in closing position with an overflow opening (12) communicating through the chamber with the output of the basin (14).

7. A sanitary appliance according to claim 1, characterized in that the movable opening and closing device is removable through the main basin.

* * * * *